United States Patent [19]

Wernicke et al.

[11] 4,210,520

[45] Jul. 1, 1980

[54] UNSUPPORTED CATALYSTS IN THE PRODUCTION OF OLEFINS

[75] Inventors: Hans J. Wernicke, Wolfratshausen; Walter Kreuter, Penzberg, both of Fed. Rep. of Germany

[73] Assignee: Linde Aktiengesellschaft, Wiesbaden, Fed. Rep. of Germany

[21] Appl. No.: 905,485

[22] Filed: May 12, 1978

[30] Foreign Application Priority Data

May 12, 1977 [DE] Fed. Rep. of Germany ..... 2721504

[51] Int. Cl.[2] ..... C10G 37/06; C10G 23/02

[52] U.S. Cl. ..... 208/57; 208/143

[58] Field of Search ..... 208/57, 58, 89, 143

[56] References Cited

U.S. PATENT DOCUMENTS

| | | | |
|---|---|---|---|
| 1,932,174 | 10/1933 | Gaus et al. | 208/89 |
| 2,093,843 | 9/1937 | McKee | 208/57 |
| 2,282,451 | 5/1942 | Brooks | 208/89 |
| 3,663,431 | 5/1972 | Wagner | 208/143 |
| 4,097,362 | 6/1978 | McKinney et al. | 208/57 |

OTHER PUBLICATIONS

"Steam Cracking," Modern Petroleum Technology, 3rd ed., p. 318, published by Institute of Petroleum, London (1962).

*Primary Examiner*—George Crasanakis
*Attorney, Agent, or Firm*—Millen & White

[57] ABSTRACT

In a process for the production of olefins in two stages wherein, in the first stage, heavy petroleum fractions are hydrogenated in the presence of hydrogen and a hydrogenation catalyst and, in the second stage, the thus-hydrogenated fractions are subjected to thermal cracking in the presence of steam, the improvement which comprises employing as the hydrogenation catalyst a support-free catalyst consisting essentially of elements from Groups VIb, VIIB, and VIII of the periodic table of the elements in the form of the metals, metal oxides, metal sulfides, or organometal complexes, or mixtures thereof.

11 Claims, No Drawings

UNSUPPORTED CATALYSTS IN THE PRODUCTION OF OLEFINS

BACKGROUND OF THE INVENTION

This invention relates to a process for the production of olefins, especially a two stage process wherein, in the first stage, heavy petroleum fractions are hydrogenated in the presence of hydrogen and a hydrogenation catalyst and, in the second stage, the thus-hydrogenated fractions are subjected to thermal cracking in the presence of steam.

Such a process has been known from DOS [German Unexamined Laid-Open Application] No. 2,164,951, and also U.S. Pat. Nos. 3,720,729 of Sze et al, Mar. 13, 1973 and 3,781,195 of Davis et al, Dec. 25, 1973. In contrast to a direct thermal cracking of heavy crude oil fractions, wherein a great amount of pyrolysis oil, tar, and coke is produced in addition to a minor yield, it is possible by means of the conventional method to produce, by catalytic hydrogenation of the crude oil fractions prior to thermal cracking, hydrogenated fractions which are suitable for thermal cracking.

The heavy petroleum fractions fed to the first stage contain a high proportion of aromatic and heterocyclic compounds. A disadvantage in the conventional process is that decomposition reactions also occur due to the acidic properties of the catalyst supports. These decomposition products in addition consume more hydrogen which otherwise would be unnecessary in this process stage.

SUMMARY OF THE INVENTION

An object of this invention is to provide an improvement in the two stage process for the production of olefins.

Another object is to provide an improvement in the hydrogenation stage by itself.

Upon further study of the specification and appended claims, further objects and advantages of this invention will become apparent to those skilled in the art.

To attain these objects, there is provided for the hydrogenation stage a support-free hydrogenation catalyst consisting essentially of substances based on Groups VIB, VIIB, and VIII of the Periodic Table of the Elements (E. H. Sargent & Co.) in the form of the metals, metal oxides, metal sulfides, or organometal complexes, or mixtures thereof. (The elements of Groups VIB, VIIB and VIII include Cr, Mo, W, Mn, Re, Fe, Co, Ni, Pu, Rh, Pd, Re, Os and Ir.)

Examples for the catalysts of this invention include, but are not limited to: Co-Mo, Ni-W, Ni-Mo, Co-W, Pd, and Pt, and also Co-Mo sulfide, Ni-W sulfide, Ni-Co-Mo sulfide, Ni-Mo sulfide, Ni-Co sulfide, and Co-W sulfide, or Co-Mo oxide, Ni-W oxide, Ni-Co-Mo oxide, Ni-Mo oxide, Ni-Co oxide, Co-W oxide, Pd oxide, and Pt oxide, as well as organometal complexes of the aforementioned metals and metallic mixtures.

With the use of the hydrogenation catalysts of this invention, naphthenes and paraffins are primarily produced in the first stage; these compounds are especially suitable for a subsequent thermal cracking step. The advantage is obtained that no decomposition products, as they may occur in the conventional process, are formed herein. Therefore, in the process of this invention, only such a quantity of hydrogen is consumed during the catalytic hydrogenation as is necessary for improving the properties of the starting material for the second stage.

Moreover, it is to be noted that the hydrogenating decomposition of the naphthenes occurring with the use of the conventional, acidic supported catalysts is accompanied by isomerization reactions of unbranched hydrocarbon chains resulting in a reduction of olefin yields during the thermal cracking step in favor of a greater yield of undesired methane. In comparison, with the use of the catalysts according to this invention, the naphthenes formed from the hydrogenation of the aromatics and the naphthenes originally present remain substantially unchanged, resulting in a lower quantity of methane being produced in the thermal cracking stage along with an increased yield of olefins.

It is of advantage for the hydrogenation temperature to be between 100° and 500° C., especially between 200° and 400° C. If the temperature is lower than 100° C., the reaction rate is generally too low for competitive purposes. Likewise, if the temperature exceeds 500° C., then the hydrogen pressure must also be very high for reasons of thermodynamics, whereby the process of this invention again becomes generally economically noncompetitive.

The hydrogen pressure required for conducting the hydrogenation stage of this invention is between 10 and 300 bar. A pressure between 15 and 150 bar is especially advantageous. If the pressure is lower than 10 bar, the hydrogenation ceases for all practical purposes. A pressure above 300 bar, on the other hand, would require a plant design, though technically feasible, resulting in extraordinarily high investment costs.

The hydrogenation is conducted essentially in the liquid phase and the thermal cracking in the vapor phase.

The process of this invention can be utilized, in particular, with gas oils which, under atmospheric pressure, exhibit a boiling range of between 190° and 380° C. However, it is also possible to use petroleum fractions which boil under atmospheric pressure in a range between 380° and 700° C. Petroleum fractions having such a boiling range are unsuitable for direct thermal cracking, since besides a small yield of olefins, additional products are pyrolysis oil, coke, and tar. The pyrolysis oil can be used merely for combustion purposes, and the two latter products contaminate the conduits and heat exchangers. Since the heavy crude oil fractions, however, are very reasonable in price, the exploitation thereof is very desirable from the viewpoint of economy.

It is advantageous if the hourly volume rate (volume petroleum per volume of catalyst per hour) of the petroleum fractions ranges between 0.2 and 10 $h^{-1}$, preferably between 0.5 and 6 $h^{-1}$. The lower limit of the aforementioned range means that, due to a long residence time of the feed on the catalyst, a great amount of crude oil is converted. At an even lower rate, a large hydrogenation apparatus must be available for a small thermal cracking furnace, which would be undesirable from an economic viewpoint. The most advantageous situation would be wherein the volume rate in the first stage is as high as in the subsequent second stage. (A high volume rate is desirable in the thermal cracking zone, since under such conditions a reformation of the cracked products into the starting fractions is less likely.) Conversely, the volume rate in the first stage, however, must not be too high, since with too short a residence time of the starting material on the catalyst of the first stage, there is no longer an adequate hydrogenation of the heavy petroleum fractions.

If the catalytic hydrogenation is conducted with a catalyst of this invention under the above-described conditions, the aromatic, especially the polyaromatic compounds are degraded, and in part split by the hydrogenation. Furthermore, the heterocyclic compounds are also cracked by hydrogenation, thus forming $H_2S$, $H_2O$ and $NH_3$. The paraffins and naphthenes contained in the starting fractions remain unchanged during the course of the hydrogenation. Isomerization reactions, which are undesirable in view of the olefin yield in the second process stage are almost entirely suppressed.

In the thermal cracking stage following the first stage, olefins are produced. In this connection, it is most advantageous if the resultant hydrogenated fractions are thermally cracked at a temperature of between 700° and 900° C., under a pressure of 1–4 bar, at a residence time of 0.01–1 second, and a steam dilution of 0.2–4.0 kg. steam/kg. hydrocarbons. Under these conditions, the ethylene-propylene yield is highest.

If the temperatures during thermal cracking are too high, increased amounts of pyrolysis oil are formed, and undesirable deposits of coke and tar occur in the cracking unit. If the residence time is too long, the yield of the reaction decreases.

The apparatus used for the process is conventional. For example, the hydrogenation may be carried out in a continuously working fixed bed reactor, being followed by thermal cracking in pipes which are heated by burners being arranged at the side walls of a cracking reactor.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

In the following examples, a gas oil having the following properties was employed as the starting material:

Density: 0.85 g./ml.
Total aromatics content: 27.7% by weight (11% by weight of polyaromatics)
C Content: 86.45% by weight
H Content: 13.13% by weight
S Content: 0.42% by weight
H/C Ratio: 1.82
Boiling range: 208°–354° C.

EXAMPLE 1 (COMPARATIVE)

The gas oil was cracked thermally without any preceding hydrogenation according to the invention at 820° C. and at a steam-hydrocarbon ratio of 1.0 kg./kg. The residence time was 0.1 second; the pressure was 1 bar.

The following yield was obtained:

$CH_4$: 10.5% by weight
$C_2H_4$: 21.0% by weight
$C_3H_6$: 12.2% by weight
$C_{5+}$-fraction: 42.0% by weight.

EXAMPLE 2

The gas oil was hydrogenated in accordance with the process of this invention under the following conditions:

Temperature: 400° C.
Pressure: 150 bar
Volume rate: 0.85 $h^{-1}$
Catalyst: Co-Mo-S, support-free An analysis of the product yielded the following:

Density: 0.78 g./ml.
Total aromatics content: 2.3% by weight
Polyaromatics content: 0.9% by weight
C Content: 85.63% by weight
H Content: 14.33% by weight
S Content: 0.04% by weight
H/C Ratio: 2.01
Boiling range: 110°–310° C.

The hydrogenation product was then subjected to thermal cracking under the same conditions described in Example 1.

The following yield was obtained:

$CH_4$: 15.2% by weight
$C_2H_4$: 30.0% by weight
$C_3H_6$: 16.1% by weight
$C_{5+}$-fraction: 20.5% by weight.

EXAMPLE 3

The gas oil was hydrogenated in accordance with the process of this invention under the following conditions:

Temperature: 400° C.
Pressure: 50 bar
Volume rate: 0.85 $h^{-1}$
Catalyst: Co-Mo-S, support-free.

A product analysis yielded the following:

Density: 0.81 g./ml.
Total aromatics content: 13.6% by weight
Polyaromatics content: 1.4% by weight
C Content: 86.54% by weight
H Content: 13.40% by weight
S Content: 0.06% by weight
H/C Ratio: 1.86
Boiling range: 170°–330° C.

The hydrogenation product was then subjected to thermal cracking under the same conditions as set forth in Example 1.

The following yield was obtained:

$CH_4$: 12.5% by weight
$C_2H_4$: 26.2% by weight
$C_3H_6$: 14.3% by weight
$C_{5+}$-fraction: 29.9% by weight.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the production of olefins in two stages wherein, in the first stage, a heavy petroleum fraction is hydrogenated essentially in the liquid phase in the presence of hydrogen and a hydrogenation catalyst and, in the second stage, and thus-hydrogenated fraction is subjected to thermal cracking in the vapor phase in the presence of steam, the improvement which comprises employing as the hydrogenation catalyst a support-free catalyst consisting essentially of at least one of Co-Mo, Ni-Mo, Co-Mo sulfide, Ni-Co-Mo sulfide, Ni-Mo sulfide, Ni-Co sulfide, Co-Mo oxide, Ni-Co-Mo oxide, Ni-Mo oxide, Ni-Co oxide, or organometallic complexes of the aforementioned metallic mixtures.

2. A process according to claim 1, wherein the hydrogenation catalyst is a Co-Mo-S support-free catalyst.

3. A process according to claim 1, wherein the hydrogenation is conducted at a temperature of 200°–400° C., under a hydrogen pressure of 15–150 bar and at a volume rate of the petroleum fraction of 0.2–10 $h^{-1}$.

4. A process according to claim 1, wherein the hydrogenation is conducted at a temperature of 200°–400° C., under a hydrogen pressure of 15–150 bar, and at a volume rate of the petroleum fraction of 0.5–6 $h^{-1}$.

5. A process according to claim 1, wherein resultant hydrogenated fractions are subjected to thermal cracking at a temperature of between 700° and 900° C., under a pressure of 1–4 bar, at a residence time of 0.01–1 second, and with a steam dilution of 0.2–4.0 kg. of steam per kg. of hydrocarbons.

6. A process according to claim 1, wherein said support-free hydrogenation catalyst is at least one of Co-Mo, Co-Mo sulfide, Co-Mo oxide, or Co-Mo organometallic complexes.

7. A process according to claim 1, wherein said support-free hydrogenation catalyst is at least one of Ni-Mo, Ni-Mo sulfide, Ni-Mo oxide, or Ni-Mo organometallic complexes.

8. A process according to claim 1, wherein said support-free hydrogenation catalyst is at least one of Ni-Co-Mo sulfide, Ni-Co sulfide, Ni-Co-Mo oxide, or Ni-Co oxide.

9. In a process for the production of olefins in two stages wherein, in the first stage, a heavy petroleum fraction is hydrogenated essentially in the liquid phase in the presence of hydrogen and a hydrogenation catalyst and, in the second stage, the thus-hydrogenated fraction is subjected to thermal cracking in the vapor phase in the presence of steam, the improvement which comprises employing as the hydrogenation catalyst a support-free catalyst consisting essentially of at least one of Co-Mo, Ni-Mo, Co-Mo sulfide, Ni-Co-Mo sulfide, Ni-Mo sulfide, Ni-Co sulfide, Co-Mo oxide, Ni-Co-Mo oxide, Ni-Mo oxide, Ni-Co oxide, Ni-W sulfide, Ni-W oxide, or organometallic complexes of the aforementioned metallic mixtures.

10. A process according to claim 9, wherein the hydrogenation catalyst is a Ni-W-S support-free catalyst.

11. A process according to claim 9, wherein said support-free hydrogenation catalyst is at least one of Ni-W sulfide, Ni-W oxide, or organometallic complexes of the aforementioned metallic mixtures.

* * * * *